United States Patent [19]

Thierion

[11] 4,402,173

[45] Sep. 6, 1983

[54] MANUALLY CONTROLLED MACHINE FOR LOADING OR UNLOADING ARTICLES IN CASES WHERE SUCH ARTICLES ARE STOWED

[76] Inventor: Michel Thierion, Muizon, France

[21] Appl. No.: 257,584

[22] Filed: Apr. 27, 1981

[30] Foreign Application Priority Data

Apr. 30, 1980 [FR] France ..... 80 09804

[51] Int. Cl.[3] ..... B65B 21/00; B65B 5/08; B65B 35/56; B65G 57/04

[52] U.S. Cl. ..... 53/538; 414/416; 414/591; 414/121; 414/71; 414/31; 53/247; 53/539

[58] Field of Search ..... 414/591, 416, 121, 72, 414/71, 70, 68, 67, 31, 749-753; 53/539, 537, 249, 247, 240, 250

[56] References Cited

U.S. PATENT DOCUMENTS

| | | | |
|---|---|---|---|
| 3,275,165 | 9/1966 | Vedvik | 414/752 |
| 3,609,938 | 10/1971 | Paddock | 53/247 |
| 3,859,772 | 1/1975 | Thierion | 414/31 |
| 4,043,097 | 8/1977 | Ishida et al. | 53/247 |
| 4,083,461 | 4/1978 | Wangermann | 414/71 |

FOREIGN PATENT DOCUMENTS

| | | |
|---|---|---|
| 1437193 | 3/1966 | France . |
| 1495501 | 8/1967 | France . |
| 1522630 | 4/1968 | France . |
| 1580926 | 8/1969 | France . |

*Primary Examiner*—Robert B. Reeves
*Assistant Examiner*—James Barlow
*Attorney, Agent, or Firm*—Murray & Whisenhunt

[57] ABSTRACT

Manually controlled handling machine for filling or emptying cases for transporting stowed articles, including a carriage (7), displaceable between a station for supplying bottles lying head to tail and a station for loading containers, bearing a tackle-block (16), and a centering frame (17) adapted to cooperate with a plate (24) equipped with gripping suction cups (25). Carriage (7) rolls on a runway (1) which is curved in a semi-circle above the containers in order to allow the loading of one half and the other half of the containers, and an orientable guiding member (28) enables the position of the plate (24) during its rising and descending movements to be corrected.

9 Claims, 4 Drawing Figures

1
2
3
7
8
10
11
12
13
14
15
16
17
18
21
24
25
C
F

MANUALLY CONTROLLED MACHINE FOR LOADING OR UNLOADING ARTICLES IN CASES WHERE SUCH ARTICLES ARE STOWED

BACKGROUND OF THE INVENTION

The invention relates to a manually controlled machine for handling articles in order to fill or to empty packing cases in which the articles are stowed.

Such a machine is mainly made for simultaneously displacing a plurality of articles which are to be placed in a case in order to constitute therein successive superposed layers or which are to be removed from this case, layer after layer. This machine is provided with gripping means, which do not form part of the invention and which are adapted to the articles to be displaced. Gripping means which are particularly suitable for equipping the machine of the invention are suction cups due to their versatility.

To give a better idea, the example will be taken hereinafter of a machine serving to fill or to empty containers used for transporting bottles lying flat; this example is frequently met with among wine producers who have to dispatch small or average quantities of full bottles. It is not profitable for these producers to equip themselves with automatic machines, which exist on the market, and whose yield attains 12 000 bottles per hour and whose cost of acquisition and service-maintenance exceeds their possibilities.

There is therefore a real need, which has not been satisfied up to the present, for a considerably less expensive machine than the high-yield automatic machines, which still calls upon manual intervention, but which can furnish the necessary forces so that the role of the man-power is devoted only to controlling the machine. As the most unpleasant part of the work is attributed to the machine, the rate of production may be accelerated; in addition, due to the power of the machine, it is possible to displace loads which exceed human capacities so that, as a whole, the number of bottles handled is considerably greater than if work were purely manual, as is the case up to the present.

The example chosen here, that of full bottles which are to be laid flat in a container, is a good example of difficult work even when it is carried out manually. The difficulty comes from the fact that the bottles are heavy since they are full and that they must be stowed head-to-tail; this arrangement is, in fact, the one allowing the maximum number of bottles to be disposed in the available inner volume of the containers currently used at present.

Containers which are not generally used for transporting full bottles lying flat have dimensions such that superposed successive layers are housed therein and, in each layer, two rows of bottles in head to tail arrangement are placed widthwise. To facilitate wedging, in the two rows of a layer, the bottles must be directed in opposite directions.

SUMMARY

The desired result is attained, according to the invention, by means of a manually controlled machine which is positioned between a station supplying full bottles and a station for supplying empty containers to be filled, or, inversely, between a station for supplying containers to be emptied and a station for evacuating the full bottles removed from the containers.

Only the case of filling containers with full bottles will be considered hereinafter in order to clarify the specification.

The machine of the invention comprises a runway supported above the two stations; this runway extends from a first end in a straight line above the bottle supply station, in the median plane of this station, then it extends up to the empty container supply station; above this latter station it is curved into a semi-circle with a diameter equal to the distance separating the longitudinal geometrical axes of the two halves, in transverse direction, of a container passing above one and the other of these axes to terminate in a second end. The runway supports a carriage driven in displacement between the first end and the second end, and vice versa. From this carriage are suspended a motorised tackle-block and a centering frame which performs a role of centering the load in high position thereof. From the tackle-block is suspended a plate which is itself provided with gripping suction cups adapted to grip a group of bottles lying flat, head to tail. The centering frame and the plate are provided with complementary centering members which engage with each other when the plate occupies its highest position.

Moreover, the plate is provided with a laterally accessible guiding member; this member preferably comprises a pair of spaced-apart arms, each terminating in a handle and it also comprises a horizontal shaft about which it may pivot in the vertical direction. The guiding member is preferably associated with the plate via a connecting and disconnecting means which releases the arm with respect to the plate when the latter occupies its highest position and which immobilises its pivoting about the plate outside this position.

The tackle-block and the centering frame are preferably suspended from the carriage via an articulation having a pivot axis parallel to the rectilinear part of the runway.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 1:
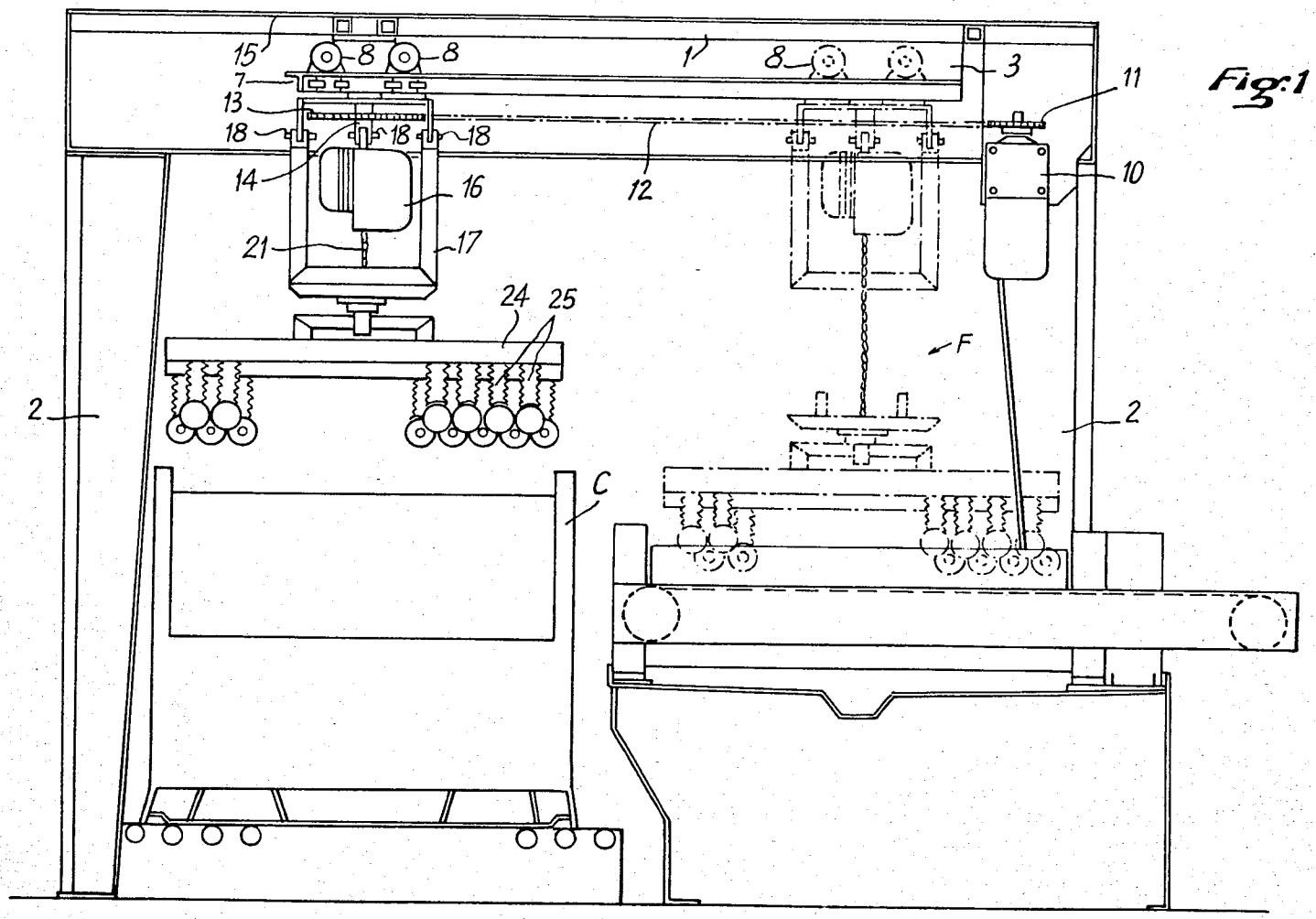
FIG. 1 is a general view in elevation of a machine according to the invention showing both a station for supplying full bottles lying flat, where the carriage, the frame and the plate are shown in dashed and dotted lines, and a station for supplying empty containers to be filled, where the carriage, the frame and the plate are shown in solid lines.

The machine of the invention is intended to be installed between a station A for supplying full bottles (or, inversely, for evacuating these bottles) and a station B for supplying empty containers to be filled (or inversely for evacuating these containers). These stations A and B may be remote from one another by any distance or close to each other, as in the present example.

The station A is equipped in manner known per se with a conveyor $A_1$ which conducts two rows of full bottles, upright, and with a device, also known per se, which lays these bottles down, head to tail. A description of a conveyor and a laying device of this type is found in French Pat. No. 73 06236 (2 219 061).

The station B is equipped in manner known per se with a roller conveyor $B_1$ which conducts and then evacuates, successively, containers C to be filled with bottles.

The equipment of stations A and B does not form part of the invention; for this reason, it is shown in a finer solid line in the drawings. Any suitable equipment may be provided at stations A and B; the only condition to be respected for the correct functioning of the machine of the invention is that a group of bottles lying head to tail must, on the other hand, be disposed at a precise position, and, on the other hand, a container to be filled must also be disposed at a precise position.

The machine of the invention comprises a runway 1 which is supported by spaced apart supports 2 above the two stations A and B. It is therefore easy to adapt the length of the runway 1 to the distance separating the stations A and B.

Figure 3:
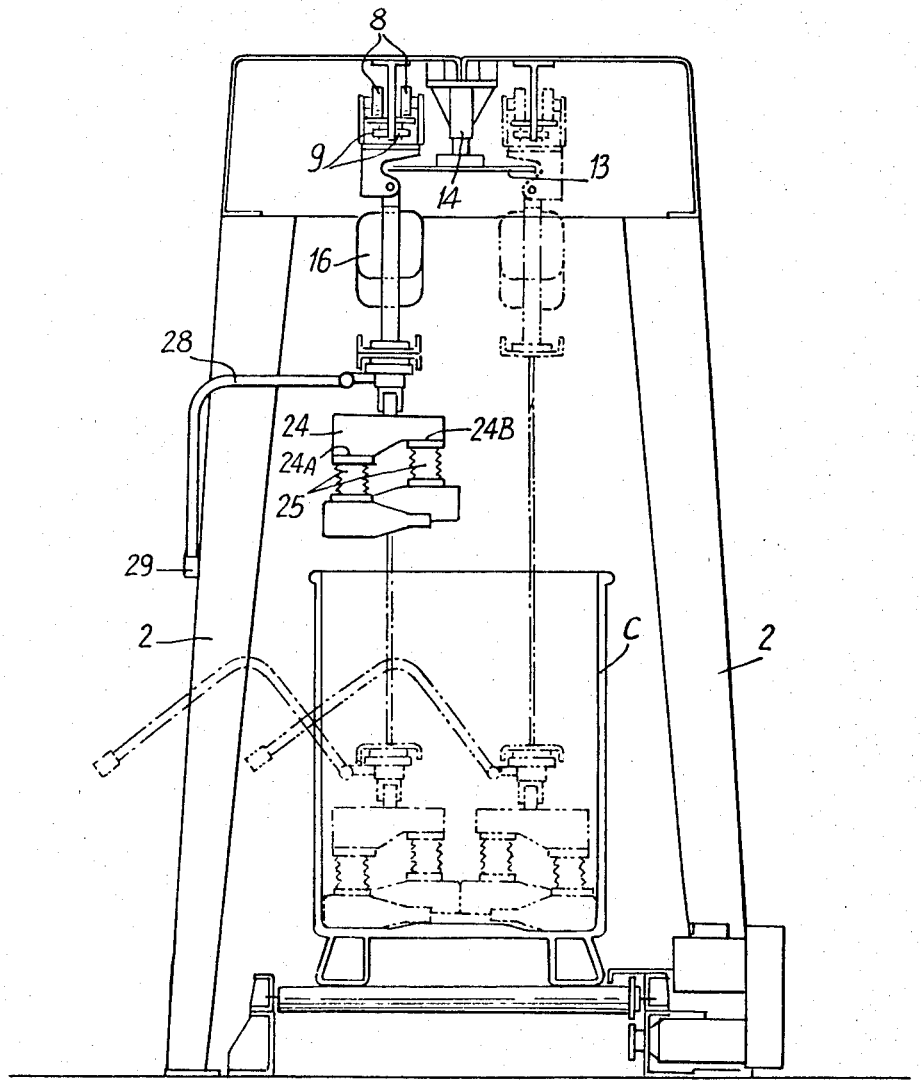
FIG. 3 is an end view of the machine of FIG. 1 showing only the container supply station where a container is being filled, the plate being shown in solid lines in high position above a row of bottles and shown in dashed and dotted lines in different manners in low position for depositing a row of bottles on the one hand and an adjacent row of bottles, facing the opposite direction, on the other hand.
Figure 4:
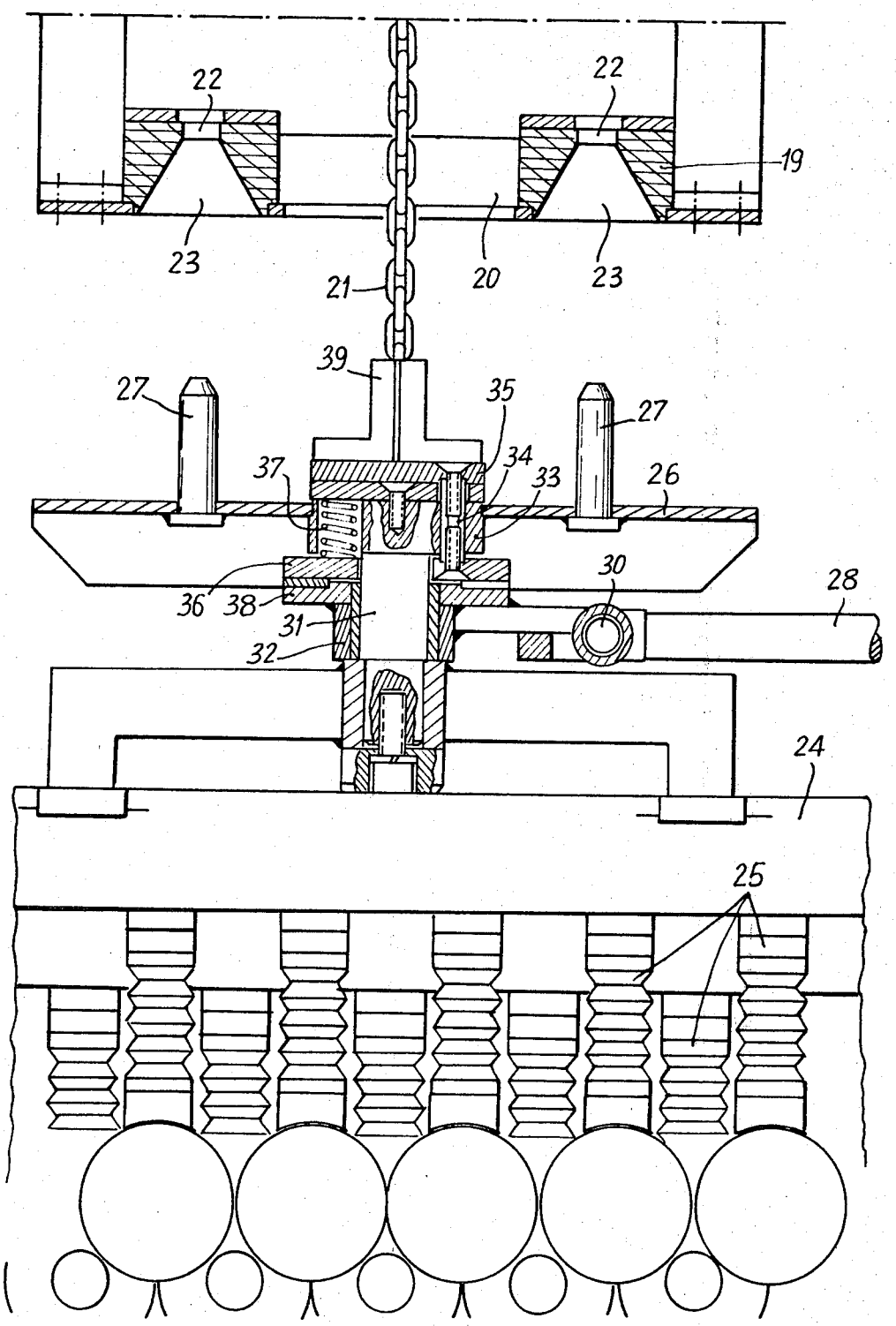
FIG. 4 is a detailed view, to a larger scale, in section through a plane passing through the axis of the portion designated by arrow F in FIG. 1.

The containers C may be of any type and of any capacity, but containers made of metal wire having standardised dimensions are currently used for transport to supermarkets. These containers may receive successive layers of flat bottles and each layer comprises, widthwise, two rows of bottles head to tail; the bottles of these rows are directed respectively in opposite directions, as may be seen in different dashed and dotted lines in FIG. 3.

The machine of the invention described here by way of example is designed to take, raise, transport between stations A and B and deposit a complete row of a layer of bottles head to tail which occupies, in a container, the whole length thereof and half its width.

Above the bottle supply station A, the runway 1 is rectilinear and located in the longitudinal median plane of this station A plumb with respect to the flat bottles to be gripped. At this station A is located the first end 3 of the runway 1. Above the container supply station B, the runway 1 is curved in a semi-circle 4, seen from plan view, and it terminates in its second end 5. The incurvation of the runway is such that it extends first above the longitudinal axis of a first half of the container C, widthwise, to arrive, after curvature, above the axis of the second half of the container C, widthwise, before terminating at 5. The centre 6 of the semi-circle 4 is preferably located on the vertical which passes through the geometrical centre of the container C, or, at least, this centre 6 is close to this vertical.

On the runway 1 is mounted a carriage 7 movable between the stations A and B; it is suitably guided, for example due to rollers 8 with horizontal axis rolling on horizontal flanges and to rollers 9 with vertical axis abutting against a vertical flange on either side thereof. This carriage 7 is moved by means of a gear-down motor unit 10 supported between the supports 2, near the first end 3 of the runway 1. The unit 10 has a vertical shaft on which is fixed in rotation a toothed wheel 11 located at carriage 7 level. A chain 12 passes around the wheel 11, extends below the runway 1, in the vertical plane which passes through the geometrical axis thereof. The chain 12 follows the path of the runway 1; arriving at the semi-circle 4, it also curves, passing around a horizontal toothed wheel 13 of diameter equal to that of the axis of the runway 1 in the semi-circular part 4; this diameter is also equal to the distance D which separated the longitudinal axes of the two halves of the container C, widthwise. From the toothed wheel 13, the chain 12 returns directly to the wheel 11. The toothed wheel 13 is suspended at suitable level due to a pendant arm 14 which is itself fixed to a plate 15 supported by the upper face of the runway 1. The vertical geometrical axis of rotation of the toothed wheel 13 through the centre 6 of the semi-circle 4. The carriage 7 is fixed to the chain 12 by a fixing means (not shown) so that it may be displaced between the end 3 and the end 5 of the runway 1, and vice versa.

From the carriage 7 are suspended a tackle-block 16 with chain and motor and a centering frame 17. It is preferable to suspend the tackle-block 16 and the frame 17 via horizontal pins 18 parallel to the runway 1 leaving the possibility of oscillation in transverse direction in order that rollers 8, 9 bear the effects of swaying less. The frame 17 has a lower side 19 with a central opening 20 through which the chain 21 of the tackle-block 19 passes. The lower side 19 also presents two spaced apart, downwardly directed holes 22 in position of use, widening at 23 in their lower part.

To the chain 21 of the tackle-block 19 is hooked a plate 24 for gripping by suction, which is horizontal in position of use and which is provided on its lower face with a plurality of suction cups 25. These latter are known; a description thereof may be found in French Pat. No. 76 34150. They are especially designed to grip horizontal bottles. The lower face of the plate 24 has two areas 24A, 24B which are offset in vertical direction and respectively equipped with suction cups 25 for the latter simultaneously to grip flat bottles head to tail in two lines as shown in the Figures. The suction cups 25 are connected via the plate 24 to a source of pressure suitably modulated by means (not shown).

The length of the plate 24 is determined by the length of the container C and its width is equal to half the length of the container C. The machine described here is designed to deposit (or remove), in one action, all the flat bottles which compose half a complete layer in the container C, operating over the whole length and over half the width. In other circumstances, with containers having other dimensions, the plate 24 may be given dimensions which would correspond to another manner of filling of emptying the container C. With containers of larger surface, the plate 24 could operate by half, widthwise, as in the present case, and by fractions, lengthwise.

The plate 24 is attached to the chain 21 of the tackle-block 16 via a centering element 26 which bears two pins 27 directed towards the frame 17, in register with the holes 22 on the lower side 19 of the latter. At the end of the lifting stroke of the plate 24, the pins 27 enter the widened inlets 23 of the holes 22 then engage therein and ensure centering of the plate 24. When the traction produced by the chain 21 firmly applies the element 26 against the lower side 19 of the frame 17, the plate 24 occupies a defined position with respect to the carriage 7 and it keeps this position during the displacement of the latter.

The top of the plate 24 is provided, between its upper face and the centering element 26, with a manual guiding member designated by general reference 28 and which preferably comprises a pair of spaced apart arms each having a handle 29. The arms of the guiding member 28 extend on one side of the plate 24, they are incurved downwardly to descend to a level which enables an operator to hold the handles 29 when the plate 24 occupies its highest position. Moreover, the guiding member 28 is mounted with freedom to pivot about a horizontal axis 30 so as to be able to be raised by rotating about this axis when the plate 24 descends to the bottom of a container C.

The manual guiding member 28 could be connected to the plate 24 at any point provided that it does not hinder the descent thereof into the containers C, as has just been explained. However, it is more advantageous to mount it around a shaft 31 due to which the plate 24 is suspended below the centering element 26. It is also preferable to provide a connecting and disconnecting means acting between the guiding member 28 and the shaft 31 so as to establish release of the guiding member 28 around the shaft 31 when the plate 24 is raised to its highest position and to establish blocking of the guiding member 28 with respect to the shaft 31 when the plate 24 does not occupy its highest position. Numerous equivalent means may be adopted to perform these functions of blocking and release. It is preferable to use automatically acting means as in the present example. The guiding member 28 comprises a ring 32 mounted to rotate freely about the shaft 31. The plate 24 is fixed to the lower end of the shaft 31 and the upper end of the latter is fixed to a central piece 33 forming part of the centering element 26. Bushes 34 pass longitudinally through the central piece 33 and are connected by screws, respectively, at their upper end to a plate 35 and at their lower end to a first coupling ring 36 which is mounted for free translation about the shaft 31 and immobilised in rotation about this same shaft. A plurality or regularly spaced apart springs 37 are housed in recesses in the central piece 33 and push the first coupling ring 36, moving it away from the central piece 33. A second coupling ring 38 is mounted to rotate freely about the shaft 31 and fixed to the ring 32 of the guiding member 28; a friction lining is interposed, in known manner, between the coupling rings 36 and 38. On the other hand, the plate 35 is firmly connected to the chain 21 of the tackle-block 16 due to right-angle bracket 39 which contain therebetween the chain 21 and which are screwed to the plate 35.

When the plate 24 has been raised up to its highest position in which the centering element is applied against the lower side 19 of the frame 17, the traction of the chain 21 is transmitted by the bushes 34 to the first coupling ring 36 which moves and compresses the springs 37 until it meets the central piece 33. The coupling is open and the guiding member 28 may rotate freely about the shaft 31 and about the plate 24. As soon as the plate 24 no longer occupies this position, as soon as it begins to descend, the springs 37 push the first coupling ring 36 against the friction lining applied against the second coupling ring 38. The coupling is closed and when the guiding member 28 is acted upon, the plate 24 suspended from the chain 21 may be rotated and given any orientation. This guiding enables its orientation to be corrected so that it penetrates suitably in the container C to be filled (or emptied).

The stop positions of the carriage 7, on the one hand, at station A and, on the other hand, at station B are defined with precision due to stops or equivalent means for detection and location (not shown) known per se, so that the corrections of orientation of the plate 24 are minimum.

Figure 2:
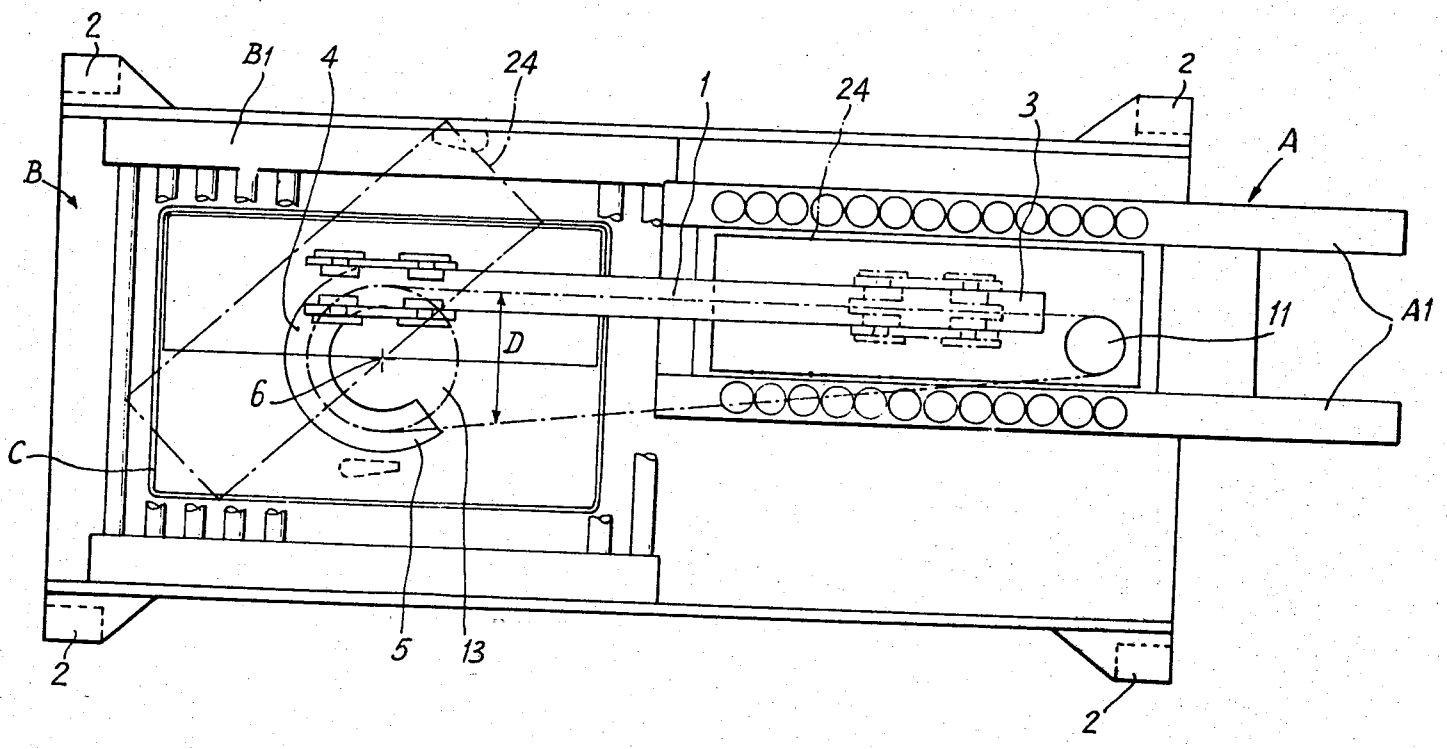
FIG. 2 is a plan view of the machine of FIG. 1 showing the same two stations.

In fact, above station B, the carriage 7 may be stopped in one or the other of two stop positions. In a first position, the plate 24 may operate on one side of the axis of symmetry of the container, for example on the side above the centre of which the runway 1 arrives. In the second position, the plate 24 may operate on the other side of the same axis of symmetry, when the carriage has passed through the semi-circle 4 of the runway 1 and has been stopped above the centre of this side. In FIG. 2, the plate 24 is shown in dashed lines, to the right, above the station A and in solid and dotted lines, to the left, during its passage between its two possible stop positions above station B.

In the example described here, when bottles have been placed horizontally head to tail at station A in the desired number to fill half the container C in one layer, the plate 24 siezes them by the suction cups 25 and the tackle-block 16 causes this plate to rise up to its highest position in which it is centred in position due to the pins 27 engaging in the holes 22. At that moment, the guiding member 28 is released to pivot about the plate 24 as has been explained. The carriage 7 is then displaced from station A to station B, by the gear-down motor unit 10 and by the chain 12. When the carriage 7 circulates over the semi-circular part 4 of the runway 1, the plate 24 pivots therewith in order to occupy in its second stop position a position symmetrical to the one which it occupies in its first stop position. The operator is not obliged to accompany the plate during this half-turn, nor to pass round the container C, due to the opening of the coupling, as explained hereinabove and to the freedom of pivoting which results therefrom for the guiding member. When the carriage 7 has been stopped at one or the other of the two positions, as soon as the plate 24 descends, the coupling closes and the guiding member 28 is immobilised with respect to the plate 24, thus enabling its orientation or its position, if necessary, to be corrected so that it descends suitably into the container C without hooking on the edges thereof. The same applies during the rise for leaving the container C. The same correction is possible when the plate 24 descends at station A to seize (or deposit) the bottles.

The improvement consisting in immobilising or releasing the guiding member 28 is not strictly necessary in all circumstances on a machine according to the invention, but its use is very advantageous.

Furthermore, it is obvious that the invention covers all modifications made to the above-described embodiment which would only be equivalent arrangements. It is also clear that the machine of the invention is suitable for handling all bottles, whatever their type, whether they are full or empty, which are to be displaced in groups of bottles lying flat and head to tail whatever the number in each group. It is also suitable for handling articles other than bottles lying flat, on condition that the plate 24 be provided with gripping means adapted to these articles. The efforts being transmitted to the tackle-block and the carriage, an operator may displace a relatively large load (25 full bottles in the above-described example) on one occasion; this operator does not have many movements to make himself, due to the pivoting of the guiding member 28. The machine described enables 3000 bottles to be handled per hour when stations A and B are close to each other. The fact of providing the semi-circular incurvation 4 of the runway 1 above the station 3 by placing the centre of this semi-circle on the vertical passing through the centre of the containers C enables the length of the displacements to be shortened. However, within the scope of the invention, it may be provided to place the semi-circle 4 beyond the station B.

The machine of the invention is robust and inexpensive to maintain and it remains simple, therefore of relatively low cost due to the fact that the guiding of the plate during its movements is ensured manually, this eliminating numerous detectors and control and monitoring circuits.

I claim:

1. Machine for loading, or unloading, bottles lying head to tail, between a first station (A) reserved for the bottles and a second station (B) reserved for containers (C), said machine comprising a horizontal runway (1) passing above said first station (A) in the longitudinal median zero thereof and above said second station (B), a carriage (7) rollingly mounted on the runway (1), a tackle-block (16) attached to the carriage (7) and having a chain for carrying a plate (24) provided with suction cups (25), the runway (1), above said station (B), having a center line which is substantially in the vertical plane of the longitudinal geometrical axis of a first half, in transverse direction, of a container disposed at said second station (B), said center line being substantially tangential to the vertical plane of the longitudinal geometrical axis of the second half due to a semi-circular incurvation (4), the plate (24) having a width equal to the inner half-width and a length equal to the inner length of the containers (C).

2. Machine according to claim 1 wherein the plate (24) is provided with a manual guiding member (28) accessible laterally to allow the correction of the orientation of plate (24) during its rising and descending movements with respect to the carriage (7) when the latter is stopped either at a stop position above said first station (A) or at either of two stop positions respectively above one half or the other half of a container at said second station (B).

3. Machine according to claim 1, wherein the carriage (7) bears a centering frame (17) provided with frame centering means (22) and the plate (24) is provided with plate centering means (27) complementary to the frame centering means (22), these frame and plate centering means (22 and 27) cooperating together when the plate (24) occupies its highest position.

4. Machine according to claim 1 wherein the carriage (7) is driven by a chain (12) passing around toothed wheels (11, 13), and wherein the centre of the semi-circular incurvation (4) of the runway (1) is located on a vertical passing through the centre of the containers (C) disposed at said second station (B) and one of the toothed wheels (13) has its centre located on this vertical.

5. Machine according to claim 1, wherein the suction cups (25) of the plate (24) are adapted to deposite or to seize bottles over the whole of a half of the surface of the containers (C), widthwise.

6. Machine according to claim 3, wherein the plate (24) is provided at its top with a shaft (31) by which it is suspended from said chain (21) of said tackle-block (16), said shaft being fixed to a centering element (26) which is provided with pins (27) adapted to engage in centering holes (22) provided in register in lower side (19) of the centering frame (17).

7. Machine according to claim 6, wherein said plate is provided with a guiding member (28) which is mounted by one end about said shaft (31) between said plate (24) and said centering element (26), said guiding member comprising a horizontal pin (30) in position of use giving it a possibility of pivoting in vertical direction.

8. Machine according to claim 7, wherein a connecting and disconnecting clutch means is placed between the guiding member (28) and the shaft (31), said clutch means being in position of closure and firmly connecting the member (28) and the shaft (31) when the plate (24) does not occupy its highest position and releasing the guiding member (28) to pivot about the shaft (31) and about the plate (24) when the latter occupies its highest position.

9. Machine according to claim 2, wherein the guiding member (28) comprises two spaced apart arms each terminating in a handle (29).

* * * * *